US005890744A

United States Patent [19]

Chan

[11] Patent Number: 5,890,744

[45] Date of Patent: Apr. 6, 1999

[54] LETTER CARD

[76] Inventor: Shin-Ho Chan, P.O. Box 24-108, Taipei, Taiwan

[21] Appl. No.: 917,536

[22] Filed: Aug. 26, 1997

[51] Int. Cl.[6] ..... G09F 1/00; A63H 33/00; A63H 33/04

[52] U.S. Cl. ..... 283/117; 283/95; 283/103; 446/220

[58] Field of Search ..... 283/95, 103, 117; 446/71, 75, 79, 80, 176, 220, 221, 222, 223, 224, 225, 226

[56] References Cited

U.S. PATENT DOCUMENTS 4,898,561 2/1990 Nottingham et al. ..... 446/220

5,199,745 4/1993 Balsamo ..... 283/117

5,573,437 11/1996 Van Dyke et al. ..... 446/220 X

*Primary Examiner*—Frances Han

*Attorney, Agent, or Firm*—Dougherty & Troxell

[57] ABSTRACT

A letter card having a covering with a tear line on the inside, and a shaped inflatable device received inside the covering, the shaped inflatable device holding an acidic chemical means and a separating layer and a basic chemical means separated from the acidic chemical means by the separating layer, the acidic chemical means and the basic chemical means being mixed together to produce a chemical reaction and to release a gas when breaking the separating layer by force, thereby causing the shaped inflatable device to swell and to come out of the covering.

2 Claims, 3 Drawing Sheets

LETTER CARD

BACKGROUND OF THE INVENTION

The present invention relates to letter cards, and more particularly to such a letter card which has a concealed shaped inflatable device that comes out when punched.

Regular post cards and letter cards simply have a plain design. These plain design post cards and letter cards impart no surprise to the addressee.

SUMMARY OF THE INVENTION

The present invention provides a letter card which imparts a surprise to the addressee when the addressee follows the instructions printed on the card base of the letter card. According to the present invention, the letter card comprises a card base printed with instructions, a covering with a tear line covered on an inner side of the card base, and a shaped inflatable device received inside the covering, the shaped inflatable device holding an acidic chemical means and a separating layer and a basic chemical means separated from the acidic chemical means by the separating layer. When the user breaks the separating layer subject to the instructions on the outside card base, the acidic chemical means and the basic chemical means are mixed together to produce a chemical reaction and to release a gas, thereby causing the shaped inflatable device to swell and to break the covering through the tear line.

DETAILED DESCRIPTION OF THE PREFERRED EMBODIMENT

Figure 1:
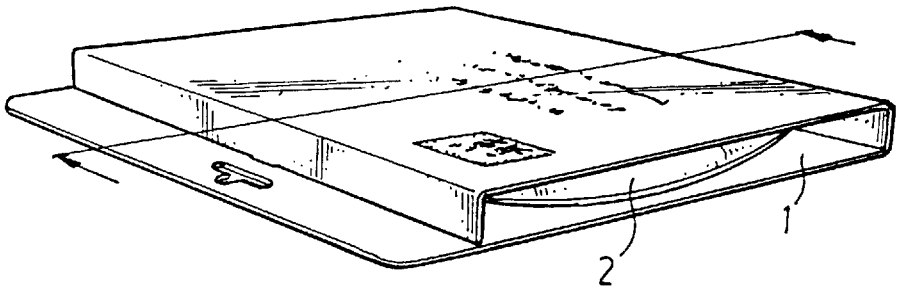
FIG. 1 is a perspective view of a letter card according to the present invention.
Figure 2:
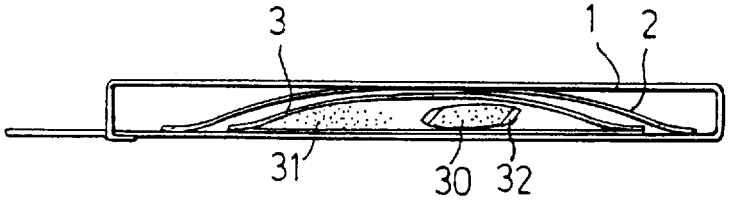
FIG. 2 is a side view in section of the letter card shown in FIG. 1.
Figure 3:
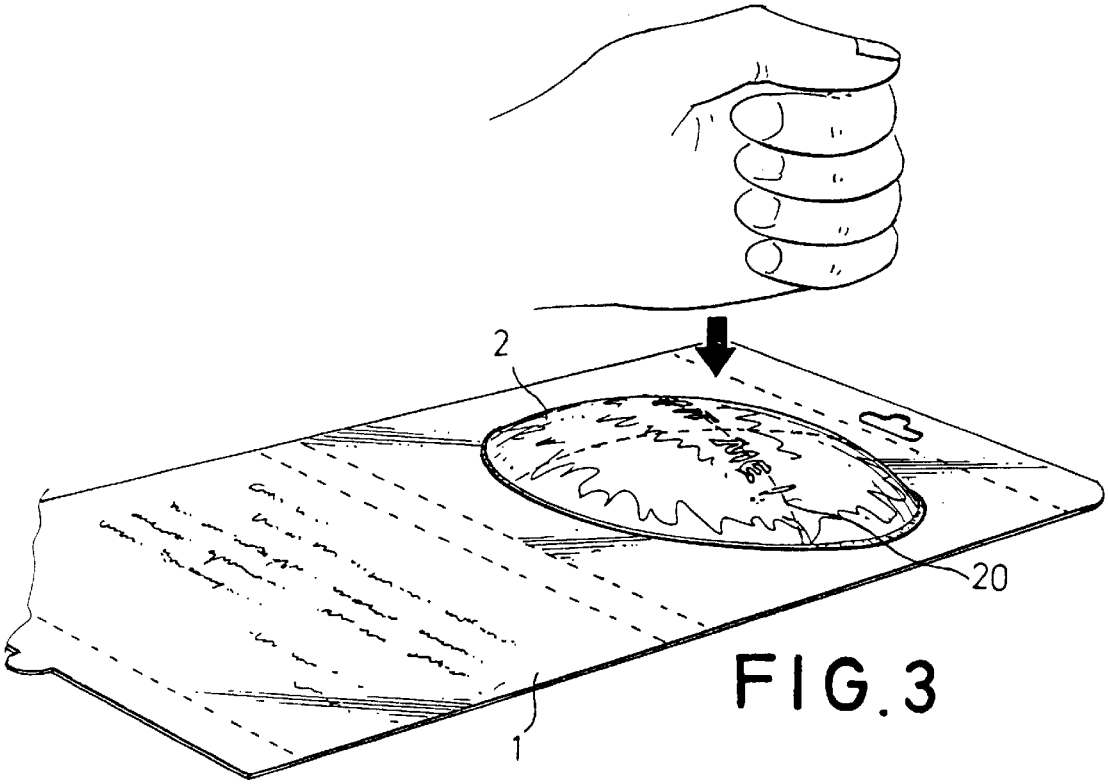
FIG. 3 shows the letter card opened according to the present invention.
Figure 4:
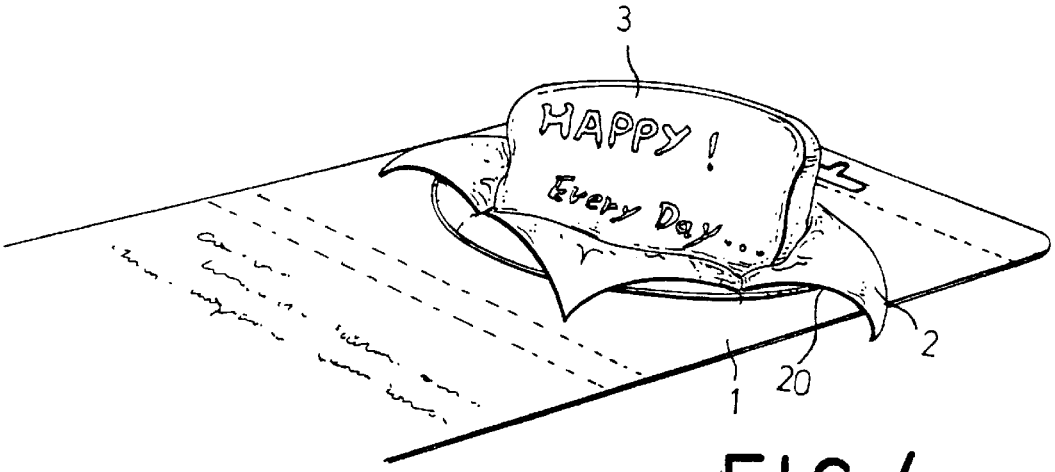
FIG. 4 shows the covering broken and the shaped inflatable device came out according to the present invention.
Figure 5:
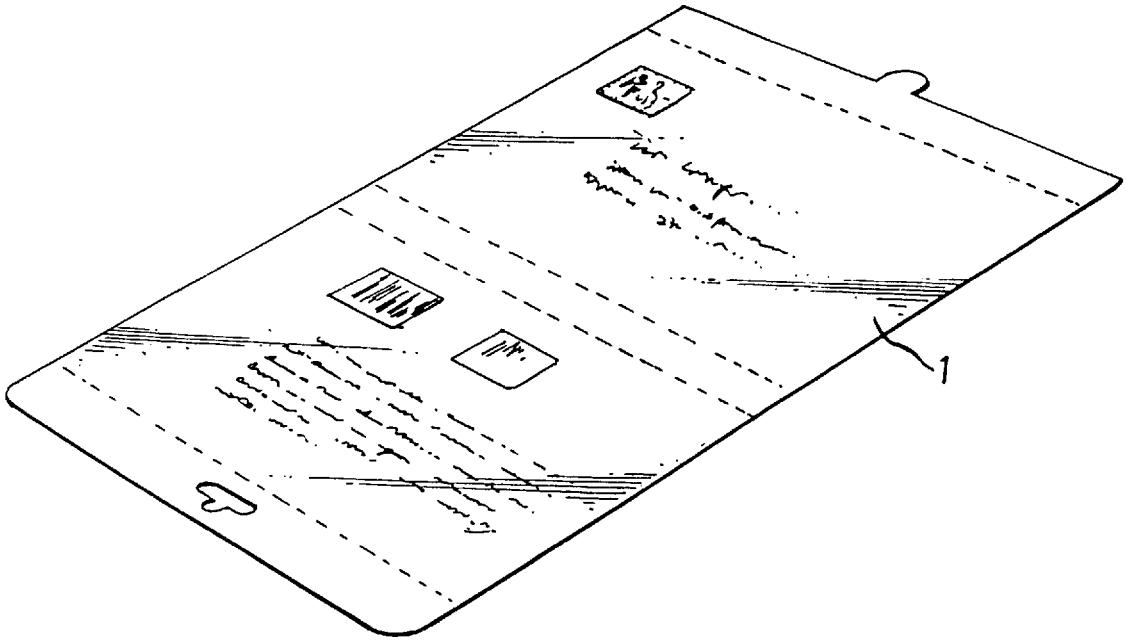
FIG. 5 shows the back side of the card base according to the present invention.

Referring to FIGS. from 1 to 5, a letter card in accordance with the present invention is generally comprised of a card base 1, a covering 2, and a shaped inflatable device 3. The card base 1 has both sides printed with instructions and drawings with a blank area left for writing. Before putting the letter card in the mailbox, the card base 1 is folded up and sealed. The covering 2 is covered on an inner side of the card base 1, having a tear line 20 to hold the shaped inflatable device 3 on the inside. The shaped inflatable device 3 is made from water-proof material, holding an acidic chemical means 30 and a basic chemical means 31. The acidic chemical means 30 and the basic chemical means 31 are separated from each other by a separating layer 32. At least one of the acidic chemical means 30 and the basic chemical means 31 is presented in the form of a liquid. The separating layer 32 breaks when receives a pressure. The shaped inflatable device 3 can have any of a variety of shapes printed with congratulations or consolatory words. Further, the covering 2 has a resealable mouth (not shown) through which the user can insert the desired shaped inflatable device 3 into the inside of the covering 2.

When the addressee received the letter card and read the instructions on the card base 1, he (she) immediately knows how to open the covering 2. The covering 2 is opened by: hitting or punching the covering 2 to break the separating layer 32. When the separating layer 32 is broken, the acidic chemical means 30 and the basic chemical means 31 are mixed together causing a chemical reaction in releasing a gas to swell the shaped inflatable device 3. When the shaped inflatable device 3 is filled up with the gas, it swells suddenly, thereby causing the covering 2 to be stretched to break at its tear line 20, and therefore the shaped inflatable device 3 comes out.

While only one embodiment of the present invention has been shown and described, it will be understood that various modifications and changes could be made thereunto without departing from the spirit and scope of the invention disclosed.

What the invention claimed is:

1. A letter card comprising a card base having both sides printed with instructions and drawings with a blank area left for writing, a covering covered on an inner side of said card base and having a tear line, and a shaped inflatable device received inside said covering, said shaped inflatable device holding an acidic chemical means and a separating layer and a basic chemical means separated from said acidic chemical means by said separating layer, said acidic chemical means and said basic chemical means being mixed together to produce a chemical reaction and to release a gas when a pressure is given to said covering against said separating layer, thereby causing said shaped inflatable device to swell and to break said covering through said tear line.

2. The letter card of claim 1, wherein said covering has a resealable mouth through which said shaped inflatable device is put inside said covering.

* * * * *